US010028576B1

(12) United States Patent
Yao

(10) Patent No.: US 10,028,576 B1
(45) Date of Patent: Jul. 24, 2018

(54) RETRACTABLE MECHANISM OF DESK

(71) Applicants: EA-HWA Enterprise Industrial Co., Ltd., Changhua County (TW); E-MAX Precision Technology Co., Ltd., Changhua County (TW)

(72) Inventor: Hung-Ping Yao, Changhua County (TW)

(73) Assignees: EA-HWA ENTERPRISE INDUSTRIAL CO., LTD., Changhua (TW); E-MAX PRECISION TECHNOLOGY CO., LTD., Changhua (TW)

( * ) Notice: Subject to any disclaimer, the term of this patent is extended or adjusted under 35 U.S.C. 154(b) by 0 days.

(21) Appl. No.: 15/786,533

(22) Filed: Oct. 17, 2017

(51) Int. Cl.

| | |
|---|---|
| ***A47B 9/00*** | (2006.01) |
| ***A47B 21/02*** | (2006.01) |
| ***A47B 9/20*** | (2006.01) |
| *A47B 21/06* | (2006.01) |

(52) U.S. Cl.
CPC ..... *A47B 21/02* (2013.01); *A47B 9/20* (2013.01); *A47B 2021/066* (2013.01)

(58) Field of Classification Search
CPC .. A47B 21/02; A47B 9/00; A47B 9/12; A47B 9/20; A47B 2021/066
See application file for complete search history.

(56) References Cited

U.S. PATENT DOCUMENTS

| | | | | |
|---|---|---|---|---|
| 6,595,144 | B1 * | 7/2003 | Doyle | A47B 9/00 108/147 |
| 7,743,716 | B1 * | 6/2010 | Burka | A47B 9/12 108/147 |
| 2001/0037751 | A1 * | 11/2001 | Agee | A47B 9/12 108/147 |
| 2009/0078167 | A1 * | 3/2009 | Ellegaard | A47B 9/00 108/21 |
| 2012/0119040 | A1 * | 5/2012 | Ergun | A47B 21/02 248/126 |
| 2016/0360879 | A1 * | 12/2016 | Kelley | A47B 21/06 |
| 2017/0251806 | A1 * | 9/2017 | Newman | A47B 21/02 |
| 2018/0000240 | A1 * | 1/2018 | Yamamoto | A47B 9/20 |
| 2018/0020828 | A1 * | 1/2018 | Nourse | A47B 21/06 |

* cited by examiner

*Primary Examiner* — Daniel J Rohrhoff
(74) *Attorney, Agent, or Firm* — Pai Patent & Trademark Law Firm; Chao-Chang David Pai

(57) ABSTRACT

A desk includes a desk top and a frame connected to underside of the desk top. Two storage boxes are respectively connected the left and right sides of the frame. Each storage box has a retractable column extending therefrom which is driven by a driving unit. Each storage box has a flexible cable manager located therein which is cooperated with multiple boxes to organize cables of computers and accessories, and the boxes are moved with movement of the desk top.

10 Claims, 15 Drawing Sheets

RETRACTABLE MECHANISM OF DESK

STATEMENT REGARDING PRIOR DISCLOSURES BY THE INVENTOR

The subject matter of the present invention was previously disclosed by the Applicants in the "COMPUTEX TAIPEI 2017", a computer technology trade show held from May 30 to Jun. 3, 2017, in Taipei, Taiwan, and therefore is a grace period disclosure under 35 U.S.C. 102(b)(1)(A).

BACKGROUND OF THE INVENTION

1. Fields of the Invention

The present invention relates to a desk with a retractable mechanism.

2. Descriptions of Related Art

Desks for office use, reading and computer should have a height-adjustable desk top to meet requirements of different users' heights, sitting postures, and keyboard and monitor positions. The height of the desk top for a simple-structured desk can be manually adjusted, and a larger desk may need to be equipped with cylinders to adjust the desk top. The mechanism for adjusting the desk top is exposed in plain view, and makes the desk look complicated. Dust can easily accumulate in the exposed mechanism and difficult to clean. Besides, when computers and other office equipment are used, the cables, adapters and cable managers are directly exposed, thus making the desk to be un-organized.

The present invention is intended to provide a desk with a retractable mechanism to eliminate the shortcomings mentioned above.

SUMMARY OF THE INVENTION

The desk according to the present invention comprises a desk top, and a frame connected to the underside of the desk top. Two storage boxes are respectively connected the left and right sides of the frame. Each storage box includes an equipping room, a cabling room and a storage room defined therein. A retractable column is located in the equipping room and is fixed to the frame. A flexible cable manager is located in the cabling room and has two ends. The first end of the cable manager is fixed to the cabling room. The second end of the cable manager extends through the storage box corresponding thereto and is fixed to a connector which is fixed to the second cabling box. The second cabling box is fixed to the frame. The cable manager has a space defined therein. The cable manager has multiple cabling holes which communicate with the space of the cable manager. Each storage box has a door. The first cabling box is connected to the two storage boxes and the two ends of the first cabling box are respectively located corresponding to the cabling rooms of the two storage boxes. The first cabling box has a space and a cover. The space of the first cabling box has multiple power sockets located therein. The space of the first cabling box communicates with the cabling rooms of the two storage boxes. A control panel is connected to the underside of the front end of the desk top and has at least one control button which controls movement of the retractable columns.

Preferably, each of the storage boxes includes an inner door located corresponding to the space of the storage room.

Preferably, a bottom box is connected to the frame and located on the underside of the rear end of the desk top. The bottom box is located next to the second cabling box. The bottom box includes a space and a lid which is accessible via an opening in the desk top. Multiple power sockets are located in the space of the bottom box.

Preferably, the desk top has at least one computer support connected to the underside thereof, and the at least one computer support is connected to the frame.

Preferably, the second cabling box includes a space and a lid. Multiple power sockets are located in the space of the second cabling box. At least one first bore is defined through the wall of the second cabling box. The space of the second cabling box communicates with the connector via the at least one first bore. At least one second bore is defined through the wall of the second cabling box. The space of the second cabling box communicates with the space of the bottom box via the at least one second bore.

Preferably, the desk top includes a rail which is an aluminum extruded rail. At least one fixing portion is connected to the rail and located corresponding to the second cabling box. An elongate opening is located at one end of the rail and communicates with the interior of the second cabling box.

Preferably, a monitor support is connected to the at least one fixing portion.

The advantages of the present invention are that the desk top is controlled to steadily move upward or downward by two retractable columns and the control panel. The maximum travel distance of the desk top is 40 centimeters. When the desk top is moved to the highest position, the height of the desk is about 120 centimeters and allows the users to use the desk while sitting or standing.

When multiple computers or accessories (speakers, mice, keyboards, ear phones, routers, adapters, and cable managers) are used, the respective cables are organized via the boxes and the cable manager.

When the desk top moves, the cable manager is flexible and movable with the desk top without tangling, pulling, interfering and dragging of the cables.

The desk is used with multiple computers, monitors and accessories, the cables are not exposed and well organized.

The storage boxes organize the retractable columns, the cable manager and the inside boxes therein, and the two rectangular storage boxes look different from legs of the conventional desk.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
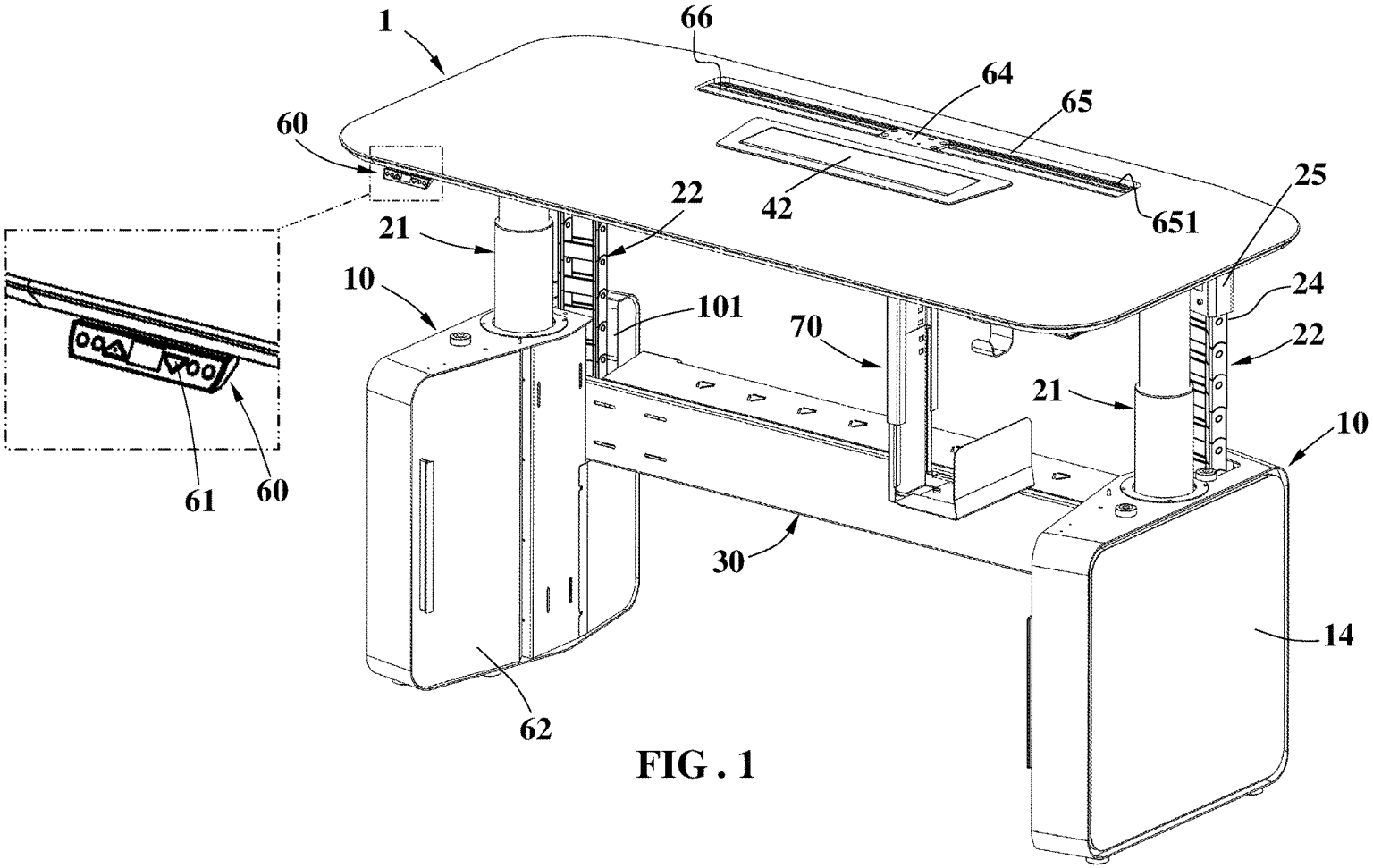
FIG. 1 is a perspective view showing the desk of the present invention.

In order to describe the characters and features of the embodiments of the present invention, the parts are drawn to illustrate relative sizes, proportions, deformations and displacements, and do not represent the real sizes of the parts.

Referring to FIGS. 1 to 4, the desk of the present invention comprises a desk top 1, and a frame 2 is connected to the underside of the desk top 1. Two storage boxes 10 are respectively connected to the left and right sides of the frame 2. Each storage box 10 includes an equipping room 11, a cabling room 12 and a storage room 13 defined therein. A retractable column 21 driven by a driving unit (not shown) is located in the equipping room 11 and has one end fixed to the frame 2. A flexible cable manager 22 is located in the cabling room 12 and has a first end 23 and a second end 24. The first end 23 of the cable manager 22 is fixed to the inside of the cabling room 12. The second end 24 of the cable manager 22 extends through the storage box 10 corresponding thereto and is fixed to a connector 25 which is fixed to a second cabling box 50. The second cabling box 50 is fixed to the frame 2. The cable manager 22 has a space 26 defined therein. The cable manager 22 has multiple cable holes 27 which communicate with the space 26 of the cable manager 22. In this embodiment, the structure of the cable manager 22 is similar to a chain and in a form of a tube. Each storage box 10 has multiple apertures 101, 102. Each storage box 10 further has a door 14 which may be removed easily.

Figure 3:
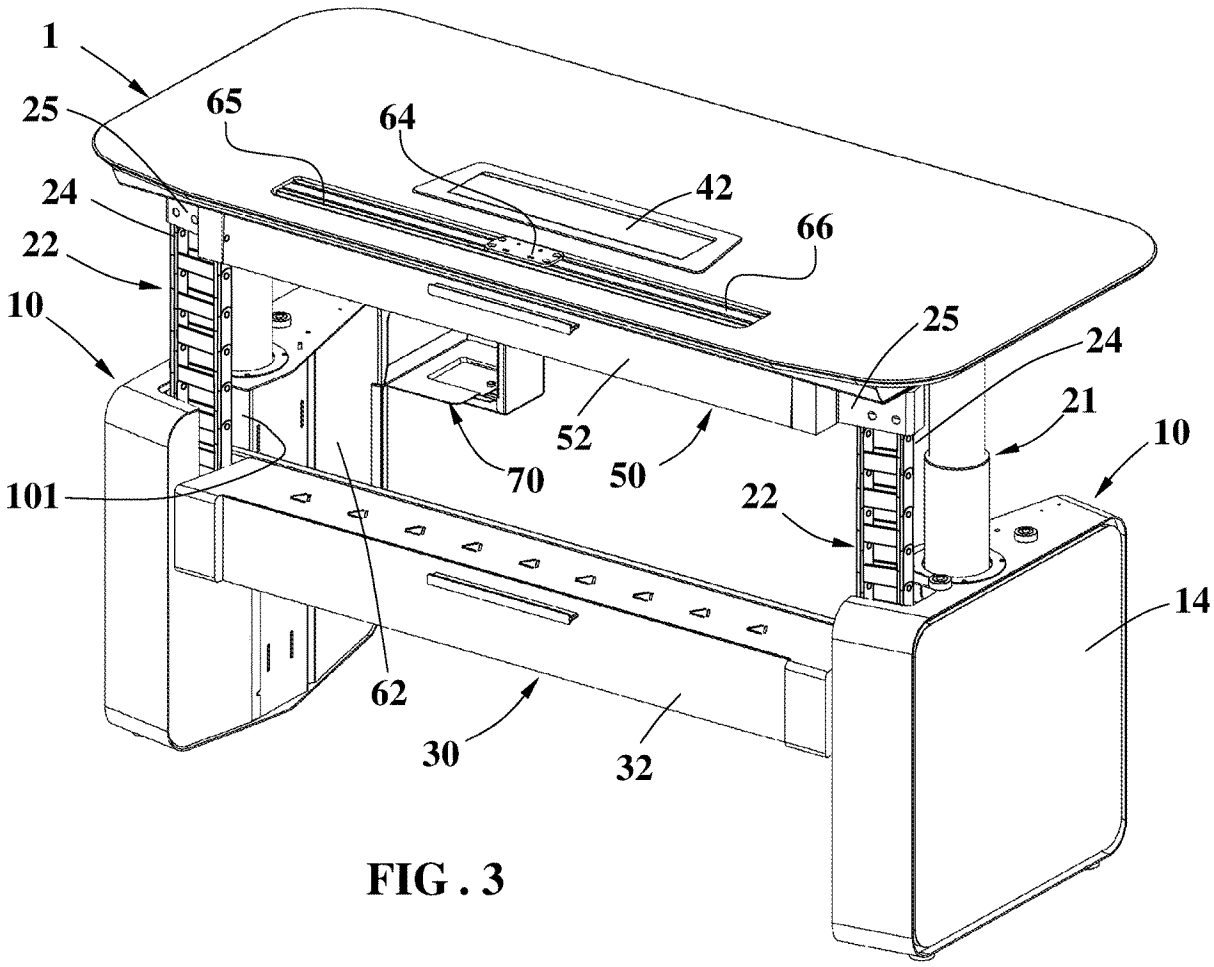
FIG. 3 is a perspective view showing the desk of the present invention, as viewed from the rear end of the desk.
Figure 4:
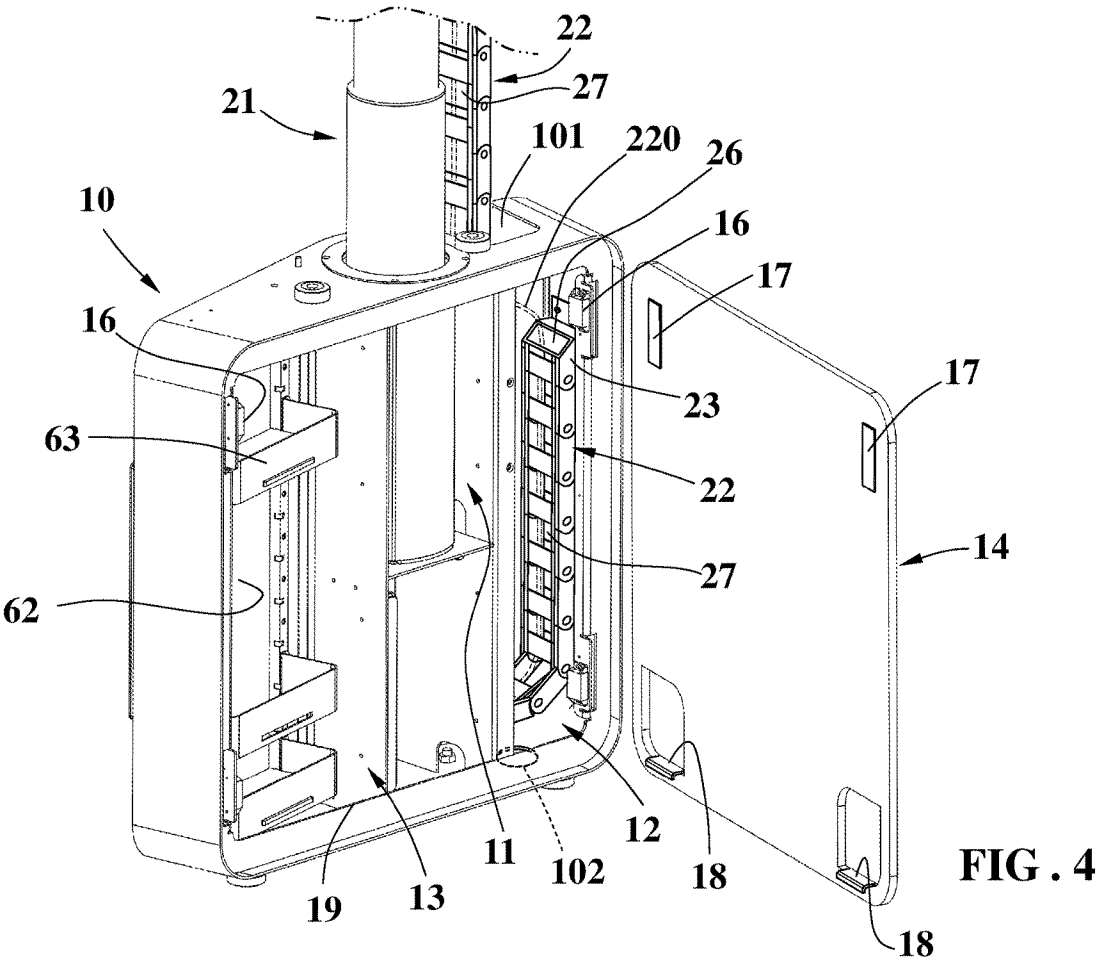
FIG. 4 shows the interior of the storage box of the desk of the present invention.

As shown in FIGS. 3 and 4, the door 14 closes the equipping room 11, the cabling room 12 and the storage room 13. Each door 14 is attached to the storage box 10 corresponding thereto by multiple magnets 16 and metal pieces 17, Furthermore, each door 14 includes multiple hooks 18 on an inside of the lower end thereof, and the hooks 18 hook the bottom frame 19 of the storage box 10 corresponding thereto. Therefore, the door 14 can be easily removed from or installed to the storage box 10.

Figure 5:
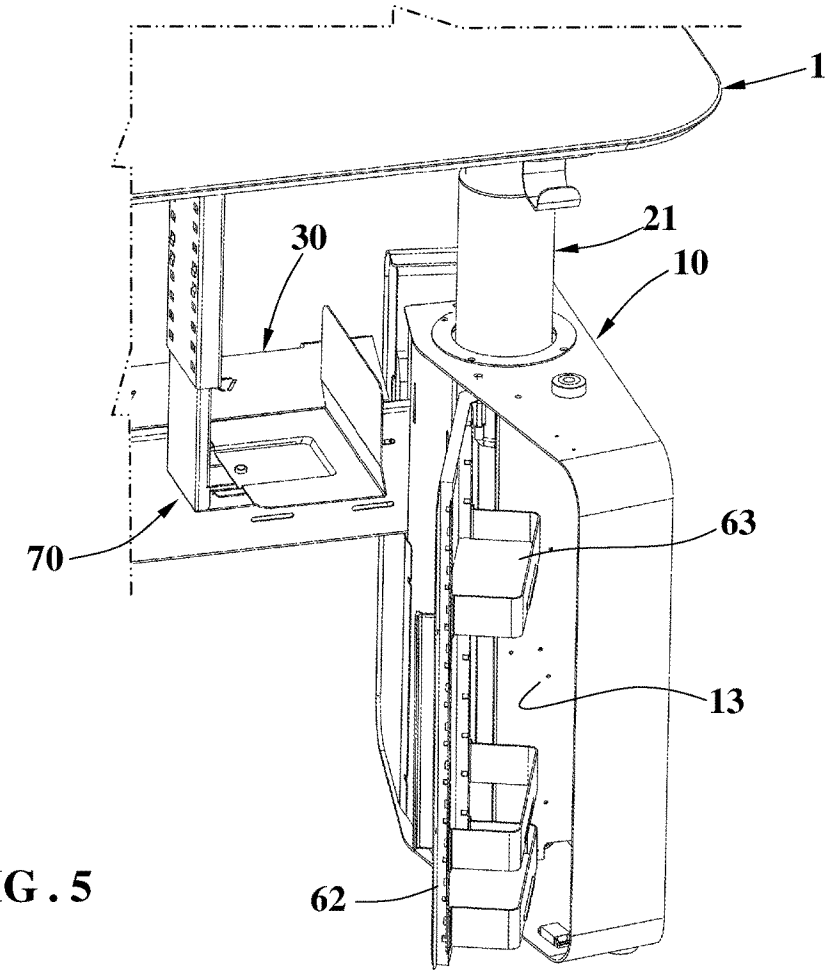
FIG. 5 is another view of the interior of the storage box of the desk of the present invention.

As shown in FIGS. 4 and 5, the third room 13 of each of the storage boxes 10 includes an inner door 62 can be opened relative to the third room 13. The inner door 62 includes multiple inner boxes 63 attached to the inside thereof. When opening the inner door 62, the users may pick goods from the inside boxes 13 or put goods into the inside boxes 13.

Figure 2:
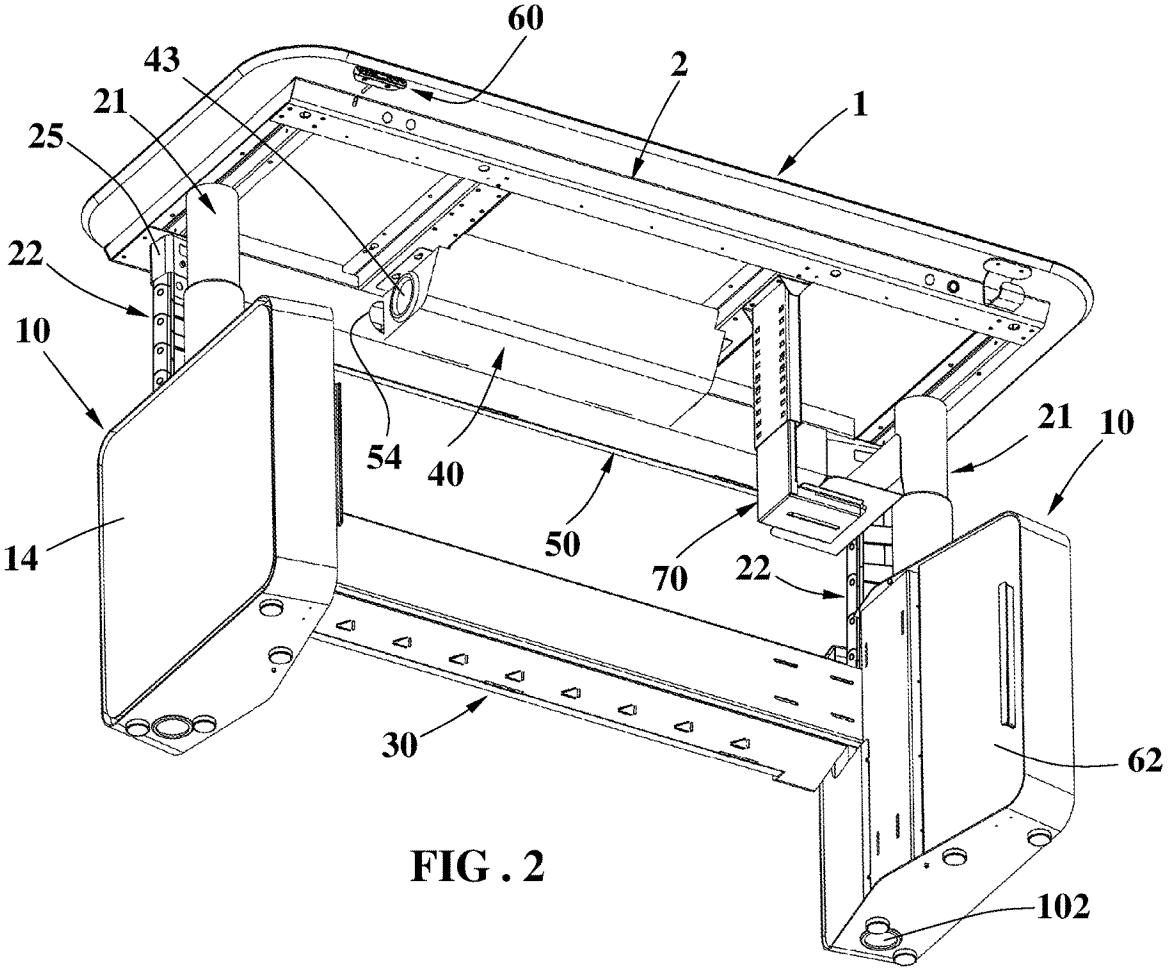
FIG. 2 is a perspective view showing the desk of the present invention, as viewed from the underside of the desk.

As shown in FIGS. 1 and 2, a control panel 60 is connected to the underside of the front end of the desk top 1. The control panel 60 is electrically connected to the driving unit (not shown) and has control buttons 61 which control the retractable columns 21 to raise or lower the desk top 1.

As shown in FIGS. 6 to 9, the movement of the desk top 1 is illustrated. In this embodiment, the maximum travel distance of the desk top 1 is 40 centimeters. When the desk top 1 is moved to the highest position, the height of the desk is about 120 centimeters. As shown in the drawing, the cable manager 22 is moved with the movement of the desk top 1. When multiple computers or accessories (speakers, mice, keyboards, ear phones, routers, adapters, cable managers) are used, the respective cables 220 of the computers and accessories, as shown in FIG. 4 and represented by dotted lines, are organized by the cable manager 22 which is flexible and movable with the desk top 1 without tangling, pulling, interfering and dragging of the cables 220.

Figure 6:
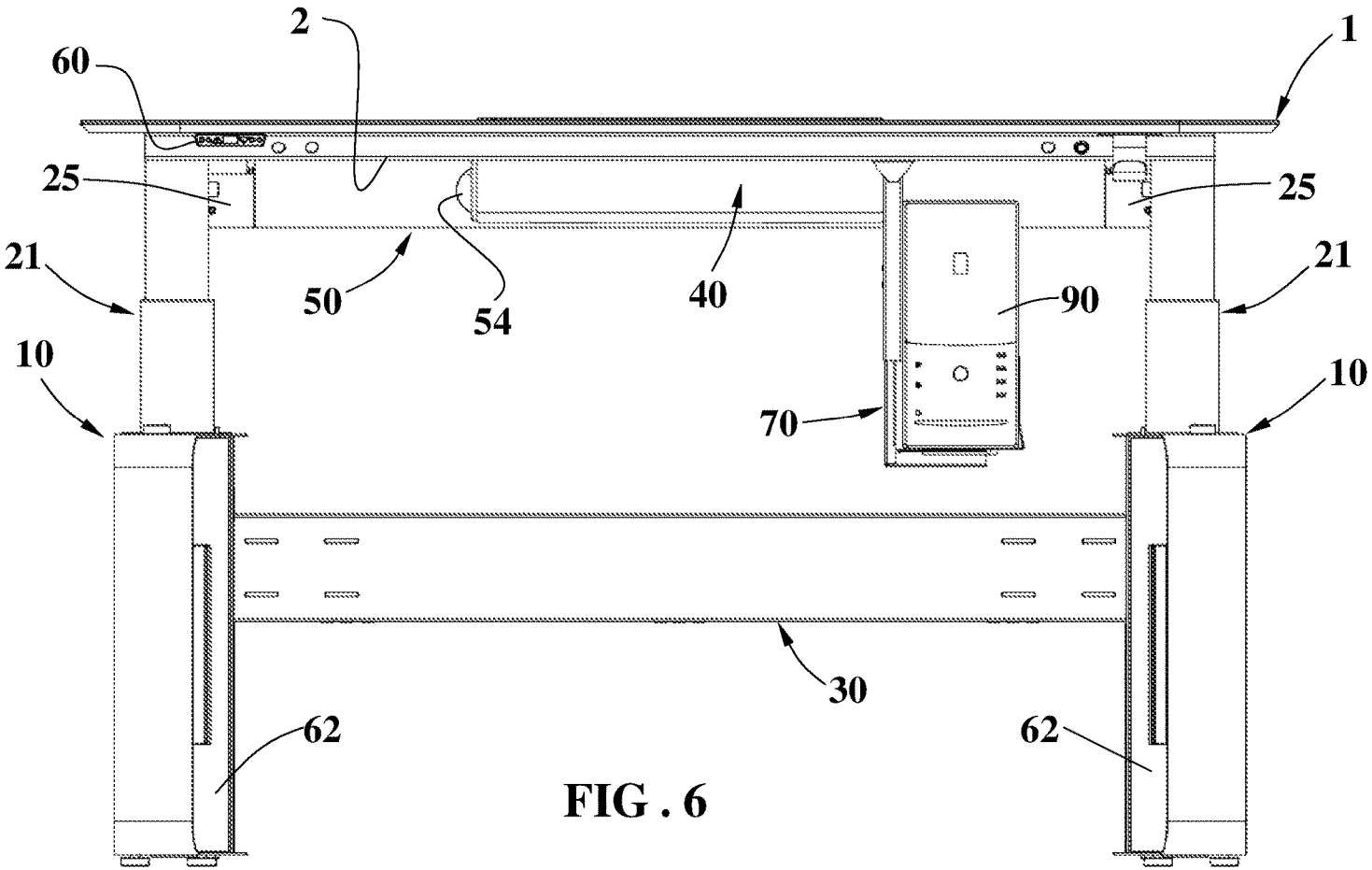
FIG. 6 is the front view of the desk of the present invention, wherein the desk top moves upward.
Figure 7:
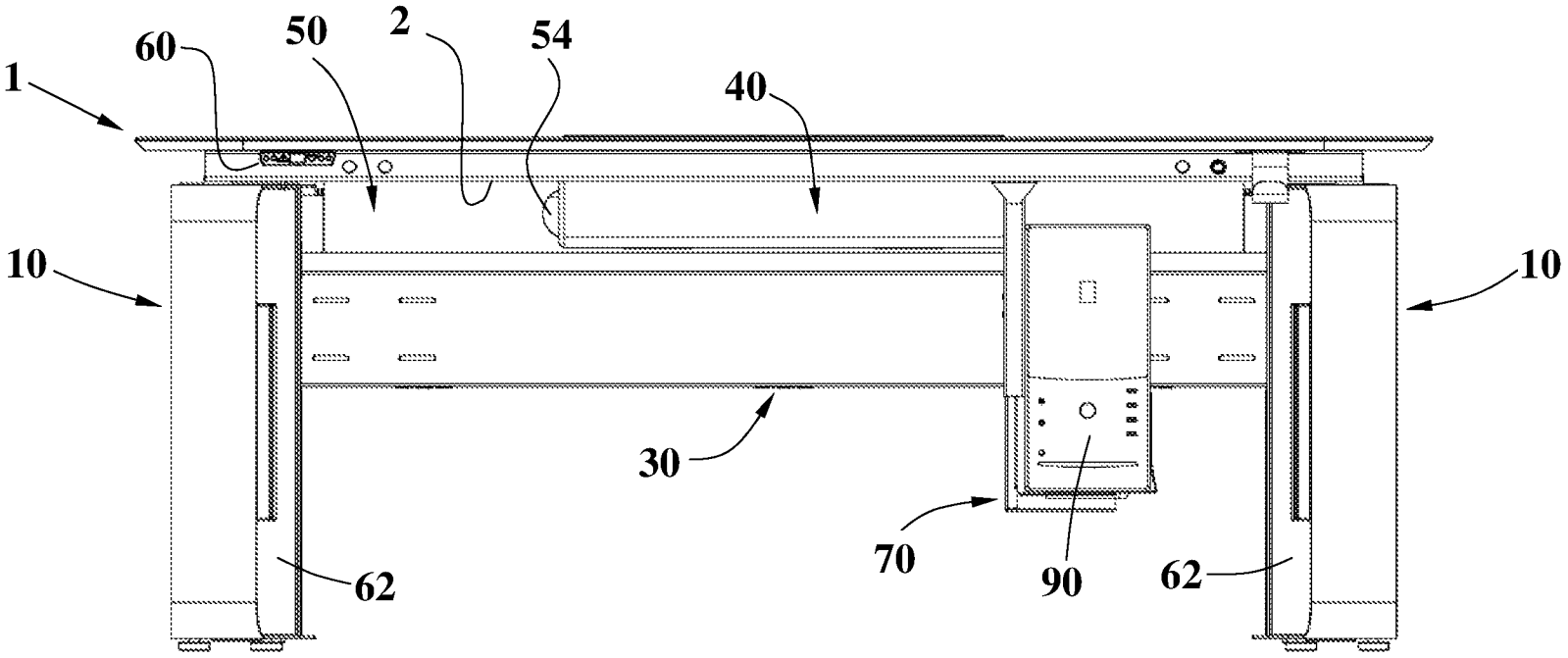
FIG. 7 is the front view of the desk of the present invention, wherein the desk top moves downward.
Figure 10:
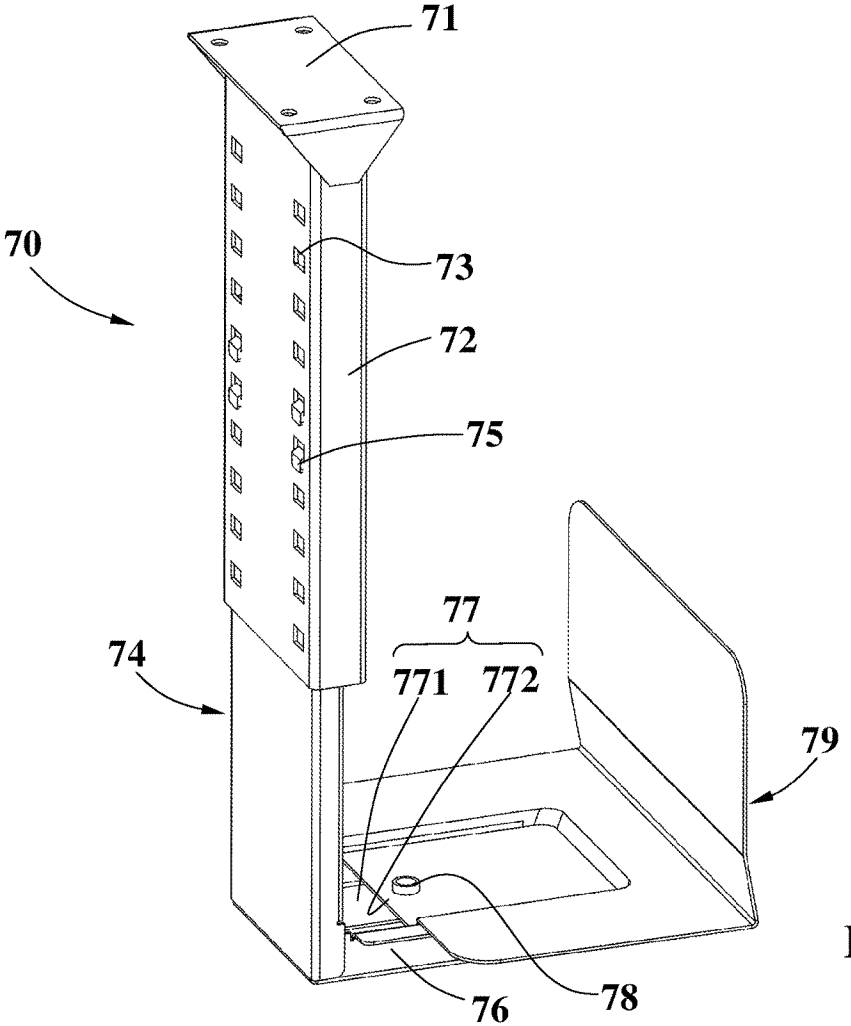
FIG. 10 shows the computer support of the desk of the present invention.
Figure 11:
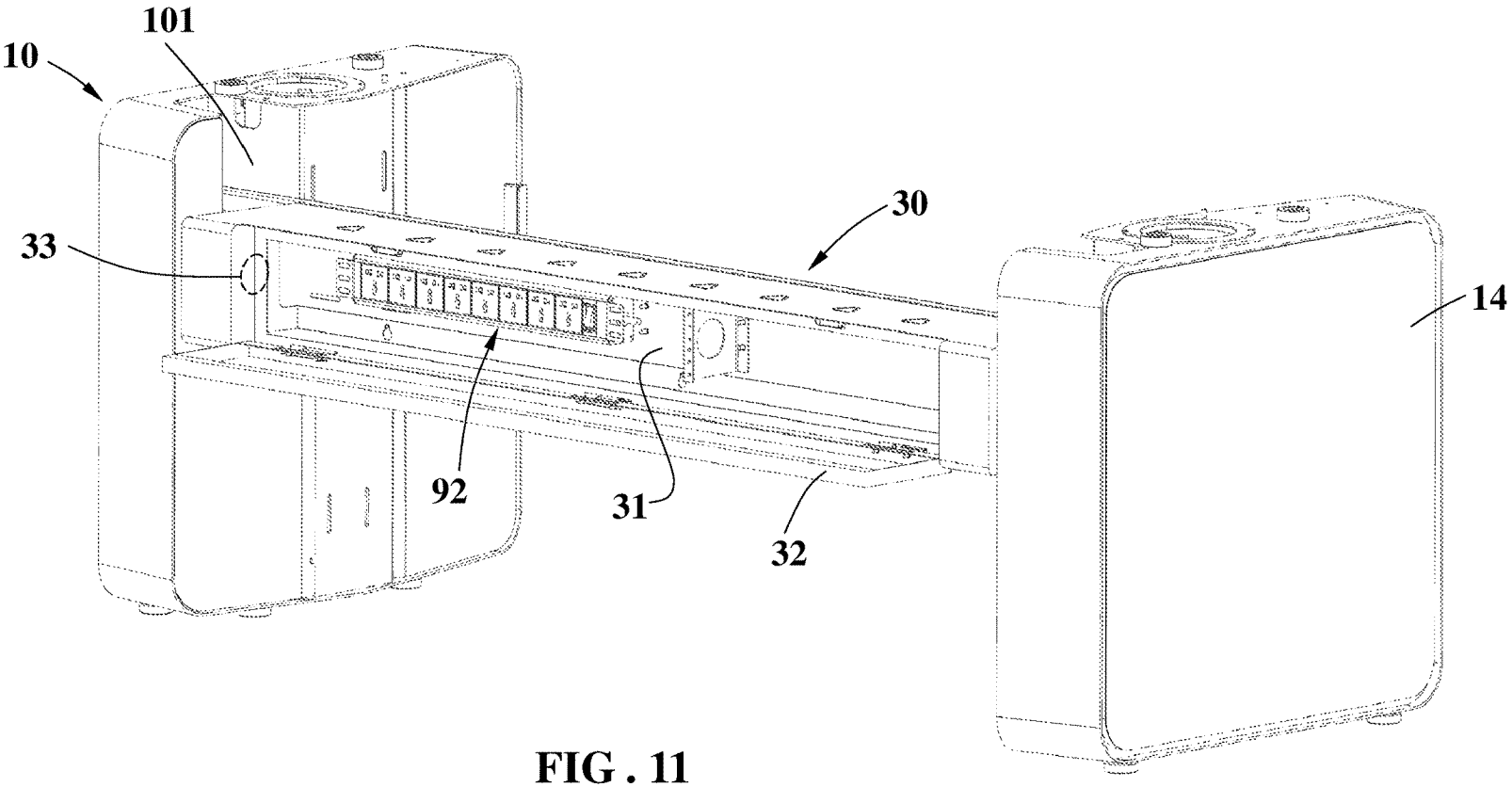
FIG. 11 shows the interior of the first cabling box of the desk of the present invention.

As shown in FIG. 10, the computer 90 is connected to the desk by a computer support 70 which is connected the underside of the desk top 1. The computer support 70 includes a top connector 71 which is connected to the frame 2 as shown in FIGS. 1 and 2. A vertical panel 72 is connected to the top connector 71 and includes multiple holes 73 located axially therein. An adjustment board 74 has at least one hooking member 75 on the rear side thereof, and the at least one hooking member 75 hooks to one of the holes 73 of the vertical panel 72. A horizontal support 76 extends from the lower end of the adjustment board 74 and is connected to a movable board 79 by a sliding unit 77 and a locking member 78 on the sliding unit 77. The sliding unit 77 comprises a recess 771 and a protruded portion 772 located between the horizontal support 76 and the movable board 79. The protruded portion 772 is movable along the recess 771 so that the movable board 79 is movable to change the relative distance from the vertical panel 72. As shown in FIGS. 6 and 7, the computer 90 is put on the horizontal support 76 and the adjustment board 74 and the movable board 79 are located on two sides of the computer 90.

Figure 8:
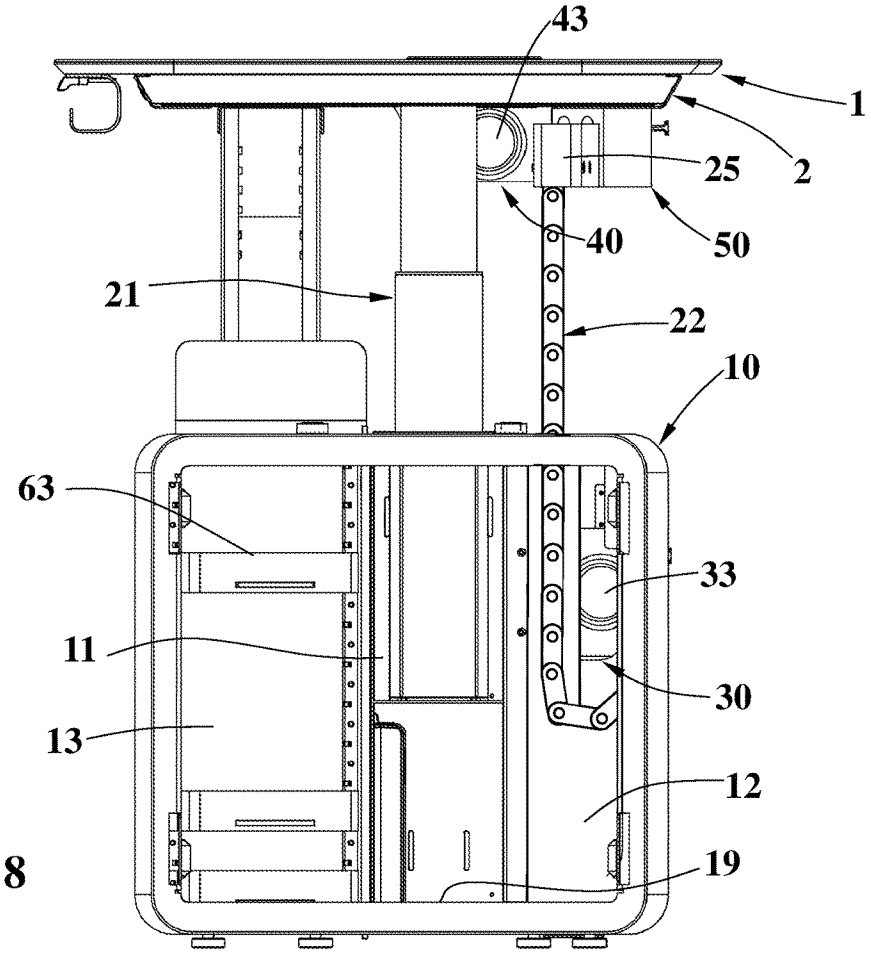
FIG. 8 is a side view of the cable manager as it is moved with the upward movement of the desk top.
Figure 9:
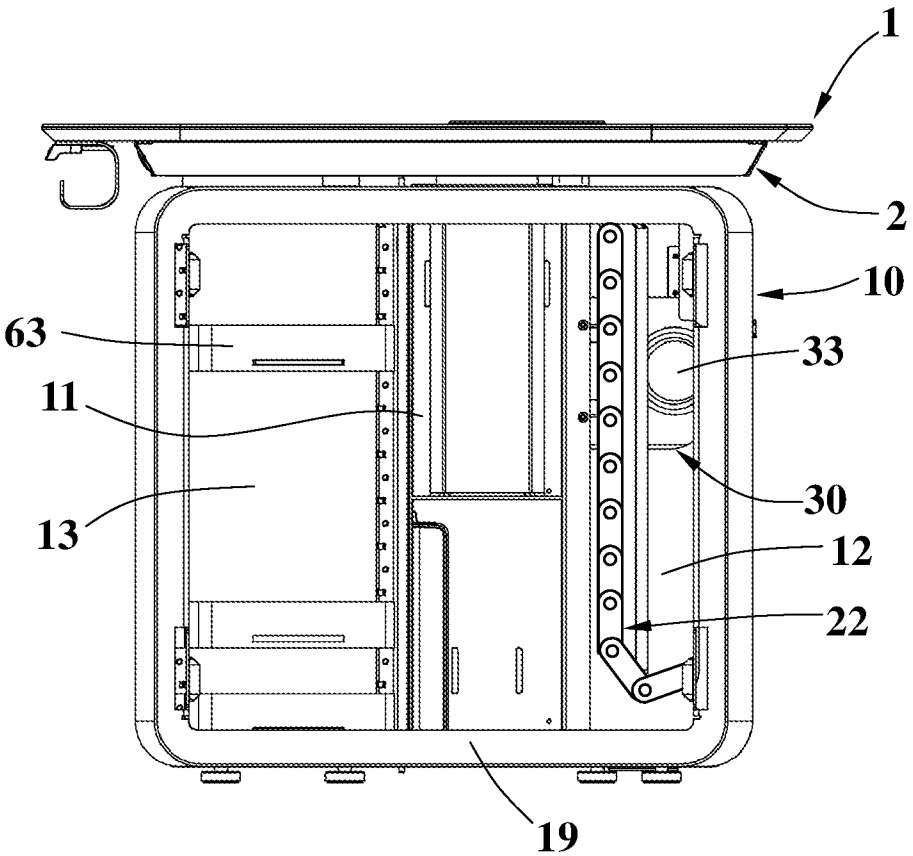
FIG. 9 is a side view of the cable manager as it is moved with the downward movement of the desk top.

As shown in FIGS. 1, 2, 3 and 11, the desk includes a first cabling box 30 which has a space 31 and a cover 32, and is connected to the two storage boxes 10, and the two ends of the first cabling box 30 are respectively located corresponding to the cabling rooms 12 of the two storage boxes 10. The space 31 of the first cabling box 30 has multiple power sockets 92 located therein. The number and type of the power sockets 92 may vary as needed. For the two storage boxes 10, the first cabling box 30 performs as a beam to position the two storage boxes 10. Each of the two ends of the first cabling box 30 has a passage 33 (as shown in FIGS. 8 and 9) which is located corresponding to the aperture 101 of the storage box 10 to communicate the space 31 of the first cabling box 30 with the cabling rooms 12 of the two storage boxes 10.

Figure 12:
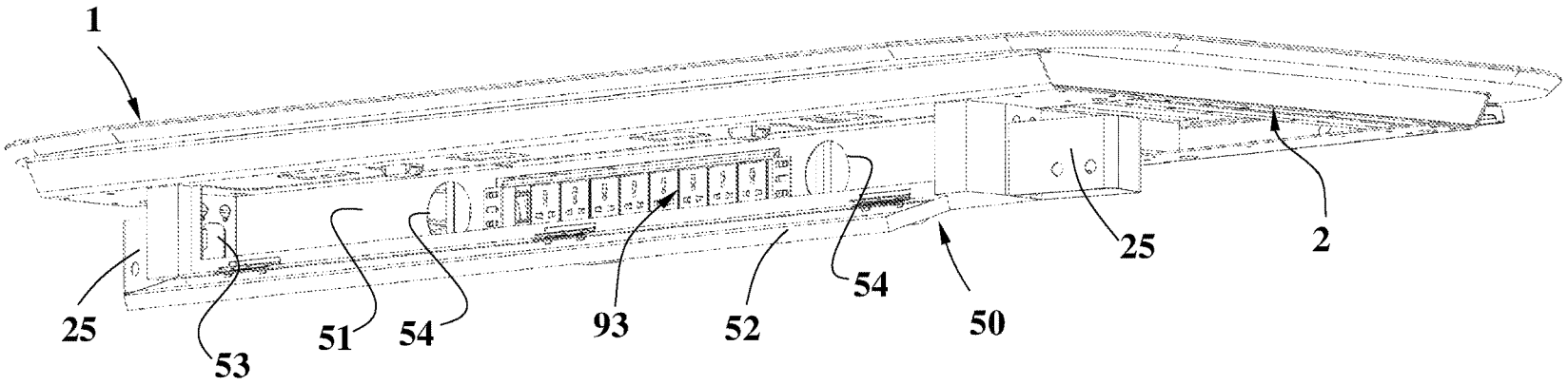
FIG. 12 shows the interior of the second cabling box of the desk of the present invention.

As shown in FIGS. 3 and 12, the second cabling box 50 includes a space 51 and an openable lid 52. There are multiple power sockets 93 located therein. The specification of the power sockets 93 are set according practical needs without being limited by the disclosure in the drawings. There are first bores 53 in the walls of the second cabling box 50 and communicate with the connectors 25.

Figure 13:
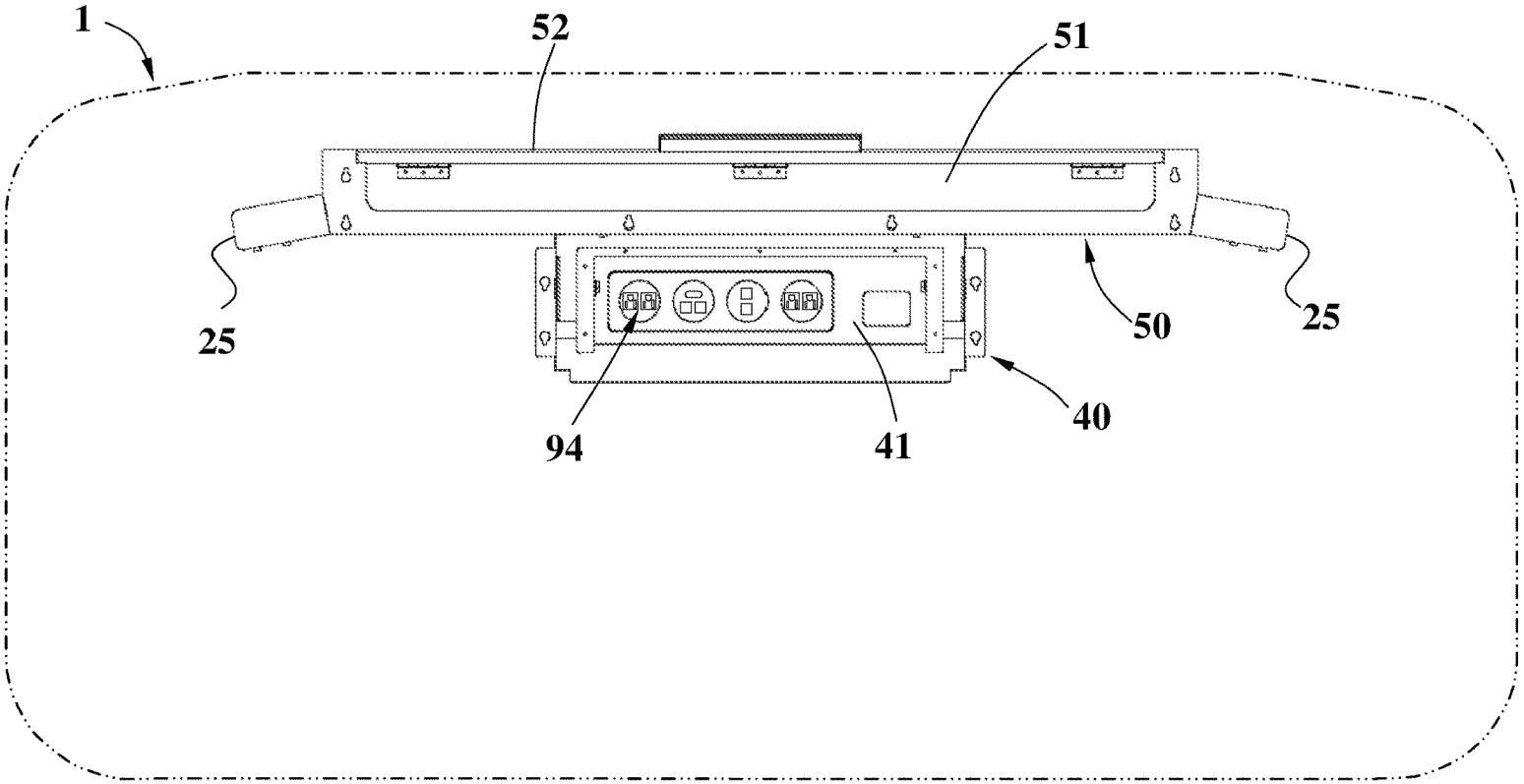
FIG. 13 shows the interior of the bottom box of the desk of the present invention.

As shown in FIGS. 2, 12 and 13, the desk includes a bottom box 40 which includes a space 41 and a lid 42 which may be accessed via an opening in the desk top 1. Multiple power sockets 94 are located in the space 41 of the bottom box 40, and the type of the power sockets 94 may vary as needed. The bottom box 40 is connected to the frame 2 and located on the underside of the rear end of the desk top 1.

The bottom box 40 is located next to the second cabling box 50. The bottom box 40 includes at least one hole 43 defined through a wall thereof, and the second cabling box 50 includes a second bore 54 so that the space 51 of the second cabling box 50 communicates with the space 41 of the bottom box 40. Multiple power sockets 93 are located in the space 51 of the second cabling box 50, and the type of the power sockets 93 may vary as needed.

The space 41 of the bottom box 40 communicates with the space 51 of the second cabling box 50. The second cabling box 50 communicates with the cable organizers 22. The bottom box 40 communicates with the cabling rooms 12 of the storage boxes 10 and the cable organizers 22. Therefore, when multiple computers and accessories are used, the cables or wiring of the accessories are organized and plugged to the power sockets 92, 93, 94. The cables and wiring are organized neatly and easily to manage, and not exposed.

Figure 14:
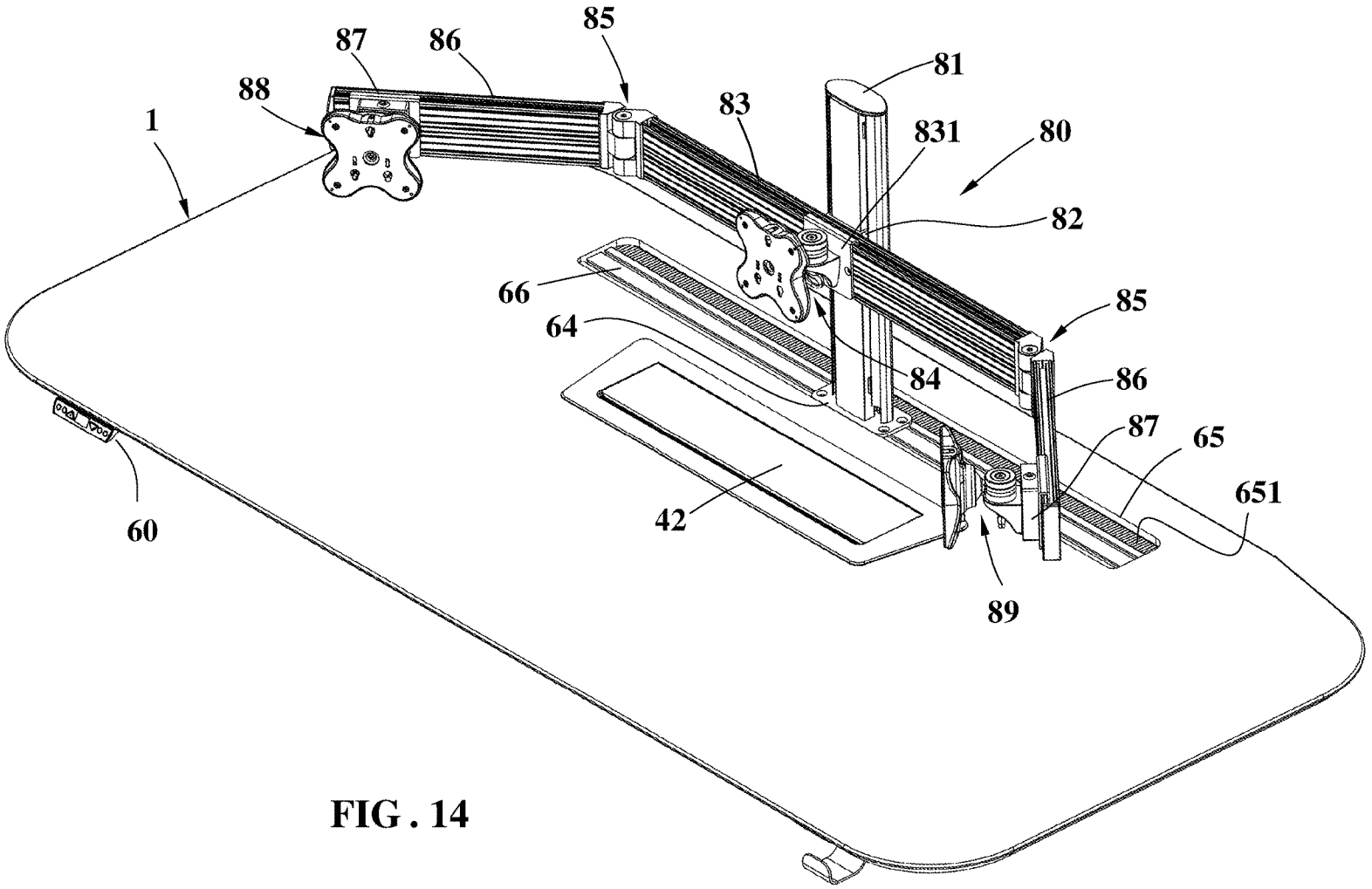
FIG. 14 shows that the monitor support is connected to the desk of the present invention.

As shown in FIGS. 3 and 14, the desk top 1 includes at least one fixing portion 64 connected to the rail 66 and located corresponding to the second cabling box 50. The rail 66 is an aluminum extruded rail. An elongate opening 65 is located one side of the rail 66 and communicates with the interior of the second cabling box 50. As disclosed, the elongate opening 65 is covered by a brush strip 651 which is used to keep dust from entering into the second cabling box 50 from the elongate opening 65. A monitor support 80 is connected to the at least one fixing portion 64.

Figure 15:
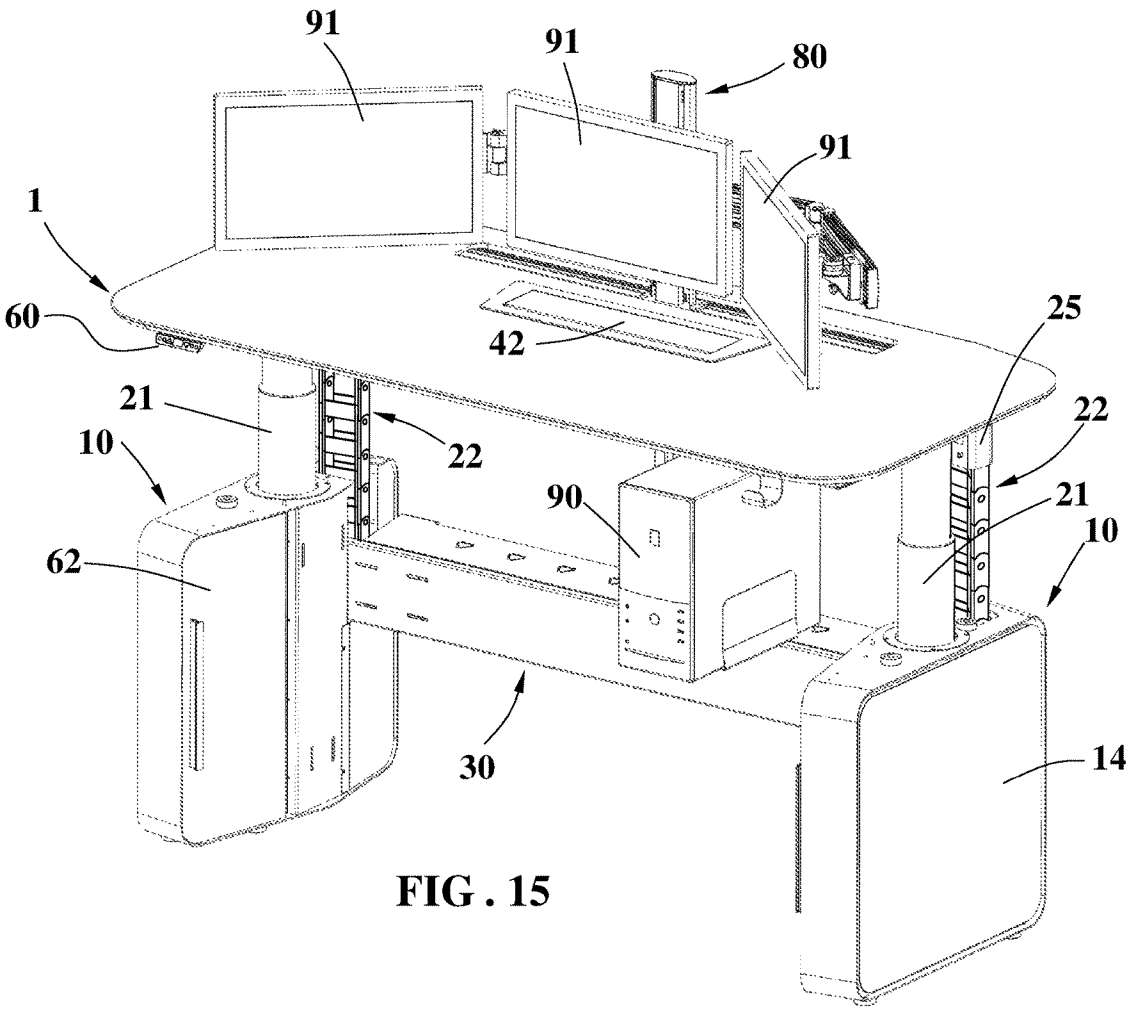
FIG. 15 shows the use of the desk of the present invention.

As shown in FIGS. 14 and 15, the monitor support 80 includes a post 81 and a first seat 82 movably positioned on the post 81, a beam 83 connected perpendicularly to the first seat 82, a second seat 831 movably positioned on the beam 83, a first monitor fixing member 84 connected to the second seat 831, two joints 85 respectively connected to two ends of the beam 83, two sub-beams 86 respectively connected to the two ends of the beam 83 by the two joints 85, a third seat 87 movably positioned on each of the sub-beams 86, and a second monitor fixing member 88 and a third monitor fixing member 89 respectively connected to the two third seats 87. The first, second and third monitor fixing members 84, 88, 89 each have a monitor 91 connected thereto.

While we have shown and described the embodiment in accordance with the present invention, it should be clear to those skilled in the art that further embodiments may be made without departing from the scope of the present invention.

What is claimed is:

1. A desk comprising:

a desk top;

a frame connected to an underside of the desk top;

two storage boxes respectively connected to the left and right sides of the frame, each storage box having an equipping room, a cabling room and a storage room defined therein, a retractable column located in the equipping room and having one end fixed to the frame, a flexible cable manager located in the cabling room and having a first end and a second end, the first end of the cable manager fixed to an inside of the cabling room, the second end of the cable manager extending through the storage box corresponding thereto and fixed to a connector which is fixed to a second cabling box, the second cabling box fixed to the frame, the cable manager having a space defined therein, the cable manager having multiple cable holes which communicate with the space of the cable manager, each storage box having a door;

a first cabling box having a space and a cover, the space of the first cabling box having multiple power sockets located therein, two ends of the first cabling box respectively connected to the two storage boxes and respectively located corresponding to the cabling rooms of the two storage boxes, the space of the first cabling box communicating with the cabling rooms of the two storage boxes, and a control panel connected to an underside of a front end of the desk top and having at least one control button which controls movement of the retractable columns.

2. The desk as claimed in claim 1, wherein each of the storage boxes includes an inner door which is located corresponding to the space of the first cabling box.

3. The desk as claimed in claim 1, wherein a bottom box is connected to the frame and located on the underside of a rear end of the desk top, the bottom box is located next to the second cabling box, the bottom box includes a space and a lid which is accessible via an opening in the desk top, multiple power sockets are located in the space of the bottom box.

4. The desk as claimed in claim 3, wherein the second cabling box includes a space and a lid, multiple power sockets are located in the space of the second cabling box, at least one first bore is defined through a wall of the second cabling box, the space of the second cabling box communicates with the connector via the at least one first bore, at least one second bore is defined through the wall of the second cabling box, the space of the second cabling box communicates with the space of the bottom box via the at least one second bore.

5. The desk as claimed in claim 4, wherein the desk top includes a rail which is an aluminum extruded rail, at least one fixing portion is connected to the rail, an elongate opening is located at one end of the rail and communicates with an interior of the second cabling box.

6. The desk as claimed in claim 5, wherein a monitor support is connected to the at least one fixing portion.

7. The desk as claimed in claim 6, wherein the monitor support includes a post and a first seat is movably positioned on the post, a beam is connected to the post, a second seat is movably positioned on the beam, a first monitor fixing member is connected to the second seat, two joints are respectively connected to two ends of the beam, two sub-beams are respectively connected to the two ends of the beam by the two joints, a third seat is movably positioned on each of the sub-beams, a second monitor fixing member and a third monitor fixing member are respectively connected to the two third seats.

8. The desk as claimed in claim 1, wherein each door is attached to the storage box corresponding thereto by multiple magnets and metal pieces, each door includes multiple hooks which hook the bottom frame of the storage box corresponding thereto.

9. The desk as claimed in claim 1, wherein the desk top has at least one computer support connected to the underside thereof, the at least one computer support is connected to the frame.

10. The desk as claimed in claim 9, wherein the at least one computer support includes a top connector which is connected to the frame, a vertical panel is connected to the top connector and includes multiple holes located axially therein, an adjustment board has at least one hooking member on a rear side thereof, the at least one hooking member hooks to one of the holes of the vertical panel, a horizontal support extends from a lower end of the adjustment board and is connected to a movable board by a sliding unit and a locking member on the sliding unit.

* * * * *